United States Patent [19]

Lukehart

[11] Patent Number: 4,867,032

[45] Date of Patent: Sep. 19, 1989

[54] THUMB PICKS FOR STRINGED INSTRUMENTS

[76] Inventor: Donald W. Lukehart, P.O. Box 1687, R.R. 4, Ottumwa, Iowa 52501

[21] Appl. No.: 105,811

[22] Filed: Oct. 8, 1987

[51] Int. Cl.[4] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 413,579 | 10/1889 | Stewart | 84/322 |
| 1,557,476 | 10/1925 | Kimball et al. | 84/322 |
| 2,221,234 | 11/1940 | Frasier | 84/322 |
| 2,234,224 | 3/1941 | Bay | 84/322 |
| 4,150,601 | 4/1979 | Henley | 84/322 |
| 4,398,444 | 8/1983 | Walker | 84/322 |
| 4,790,227 | 12/1988 | Lukehart | 84/322 |

*Primary Examiner*—Lawrence R. Franklin
*Attorney, Agent, or Firm*—Kenneth T. Theodore

[57] ABSTRACT

The invention is an improvement in thumb picks for stringed musical instruments whereby the pick is self secured to the thumb and can be utilized in both the upstroke and downstroke without the aid of any other finger. The pick consists of an oval shaped band formed to match the shape of a user's thumb and which applies a compressive force upon the thumb. A picking tip traverses at the bottom of said pick at an attitude approximately perpendicular to the instrument strings. A tip support element cooperates with said tip by providing additional strength thereto. An open section of said band permits flexibility thereof and is positioned to prevent a string from accidently catching itself therein.

5 Claims, 1 Drawing Sheet

THUMB PICKS FOR STRINGED INSTRUMENTS

BACKGROUND OF THE INVENTION

1. Field of the Invention

This invention lies within the field of musical instruments, specifically stringed musical instruments.

2. Description of the Prior Art

Thumb picks are common items in the prior art. Typically they consist of a circular or semi-circular band of material designed to fit over a user's thumb. A picking tip element projects outwardly therefrom. In general, the prior art resembles a fish hook shape whereby the thumb is fitted in the circular portion and the 'shank' is the picking tip.

A major disadvantage of the prior art is that a string can catch itself in the open area of those bands which are 'C' shaped, or semi-circular. This prohibits using those examples of prior art in the upstroke.

Another disadvantage is that the picking tip is made of the same material as the band. This insures a compromise between the flexibility required by the picking tip and the stiffness required by the band. This also insures a pick not suited to its purpose.

SUMMARY AND OBJECTS OF THE INVENTION

The improved pick consists of an open oval shape to securely fit around the user's thumb tip. A picking tip extends radially outwardly from the bottom of said band at an attitude approximately perpendicular to the instrument's strings. A tip support element at the bottom of said tip provides the strength and flexibility to said tip for proper usage. A surface protrusion, located at the open end of said band, projects upwardly and into the soft portion of the user's thumb. Said protrusion impresses itself into the skin when the pick is used in the upstroke and thereby prevents rotation of the pick about the thumb.

It is an object of the invention to provide a thumb pick which can be used in both the upstroke and downstroke without moving on the thumb and which will not accidently catch upon a string.

DESCRIPTION OF THE PREFERRED EMBODIMENT

While the preferred embodiment is illustrated and described below, it is to be understood that variations will be apparent to those skilled in the art without departing from the principles of the invention. Accordingly, the invention is not to be limited to the specific form as described and illustrated but rather is to be limited only by a literal interpretation of the claims appended herein. As an example, the below teachings describe an embodiment for those skilled in the art, the principles apply equally to a left handed user.

Figure 1:
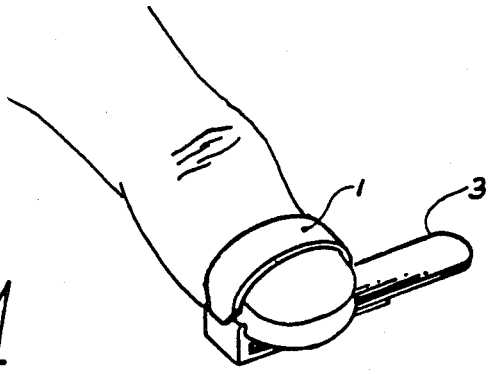
FIG. 1 is a perspective view of the pick as installed on a user's thumb.

FIG. 1 illustrates the invention, an improved thumb pick 1 fitted to the thumb of a right handed user. An open oval shaped thumb band 2 almost completely surrounds the thumb at approximately the nail cuticle area. Said band 2 is approximately one-half inch in width and is shaped to match the profile of the thumb, as taught below.

Said band 2 is designed to have a similar but slightly smaller profile than the user's thumb. The degree of size difference is dependent upon the material's modulus of elasticity, which determines how far the band 2 can be stretched and, more importantly, how adequately said band 2 attempts to return to its original shape, once stretched. The novel aspect of the invention is its ability to compress itself about the user's thumb and securely grip itself about the thumb.

An open section 8 of said band 2 provides the band 2 with the capability to be expanded (or opened) by the user for ease of installation on the thumb. Said section 8 also permits the band 2 to utilize its inherent flexibility by compressing itself about said thumb in attempting to regain its original size. In this manner, said band 2 is in full and uniform compressive contact with the thumb throughout its surface area.

Figure 2:
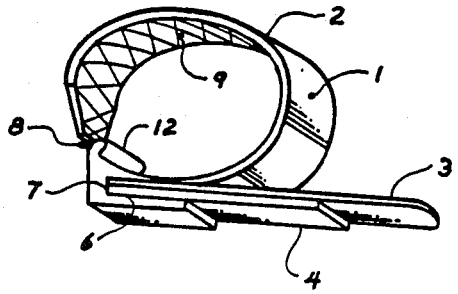
FIG. 2 is a perspective view of the lower portion of the pick to illustrate specific elements thereon.

A picking tip 3 extends radially outward from the bottom of said band 2 such that during playing, said tip 3 is approximately perpendicular to the strings of the musical instrument. Below and in cooperating contact with said tip 3 is a tip support element 4 having a length approximately seventy-five percent that of said tip 3, as illustrated in FIG. 2. Said element 4 is of a material slightly more rigid than that of the tip 3 material and having more strength. This selection of materials permits said tip 3, acting as a non-uniform cantilevered beam in combination with the element 4, to have the requisite flexibility at its far end for stricking the strings and to have the requisite strength at the base, or opposite end.

Said tip 3 and element 4 are secured to said band 2 by a slot 6 formed upon the lower portion of said band 2. Said slot 6 is of a rectangular shape and sized to accept and secure said tip 3 and element 4 within, using attachment means 7. Said means 7 can be of the adhesive type, as illustrated, or of mechanical means, such as a standard rivet.

Said section 8 is intentionally positioned on the side of the band 2 opposite the instrument's strings. By this placement, the pick 1, during play, is incapable of accidently catching a string within said section 8.

A triangular shaped surface protrusion 12, located upon the lower portion of said band 2 closest to said section 8, projects upwardly and inwardly from the surface thereof and into the soft bottom of the user's thumb. Said protrusion 12 extends along the total width of said band 2 with a height of approximately one-eighth inch. Said protrusion 12 functions as a fulcrum when the pick 1 is used in an upstroke manner. By reference to FIG. 2, an upstroke will bend said tip 3 and element 4 downwardly, thereby impressing said protrusion 12 upwardly into the skin. This impression into the skin prevents said pick 1 from rotating counterclockwise about the thumb.

The inside surface of said band 2 which is in contact with the thumb has a friction surface 9 thereon to increase the friction between thumb and band 2. FIG. 2 illustrates a knurled surface as the friction surface 9, although adhesives, rubber, foam and the like are all proper surfaces 9.

Material selection for said band 2 requires a material having a high elastic limit such that it will return to its original shape and size after installation upon the thumb. The material must be easily formed or extruded to obtain the requisite profile and be compatible with said means 7. Generally, a proper selection of a plastic, nylon or fiberglass will provide the requisite qualities. Materials for said tip 3 and element 4 also require a high elastic limit and compatibility with said means 7.

Having thus described my preferred embodiment, what I claim is:

1. A thumb pick for stringed musical instruments, comprising:

an oval shaped thumb band having a profile similar to the shape of a user's thumb, said band having a flexible portion adapted to compressively grip the user's thumbnail and a bottom portion having an interior surface adapted to grip the bottom of the user's thumb, said flexible and bottom portions being joined together at one end and having a second end spaced apart defining an open section;

a slot formed on the exterior surface of said bottom portion;

an elongated, flexible picking tip having one end fixed in said slot, one surface of said picking tip being adjacent said bottom portion of said band;

an elongated tip support element having one end fixed in said slot, said tip support element resting in contact with the surface of said picking tip away from said bottom portion, said support element having generally the same width but being approximately seventy-five percent as long as said picking tip; and the other ends of said picking tip and said tip support element extending tangentially from said band away from said open section.

2. The thumb pick of claim 1 wherein said tip support element is slightly more rigid than said picking tip.

3. The thumb pick of claim 1 wherein the inside surface of said band has a friction surface thereon to increase the friction between the thumb and the band.

4. The thumb pick of claim 1 wherein a triangular shaped protrusion projects inwardly and upwardly from the inside surface of the bottom portion of the band closest to said open section such that said protrusion impresses itself into the thumb skin upon an upstroke of the pick.

5. The thumb pick of claim 4 wherein said protrusion has a height of approximately one-eighth inch.

* * * * *